US007794516B2

(12) United States Patent
McAllise et al.

(10) Patent No.: US 7,794,516 B2
(45) Date of Patent: Sep. 14, 2010

(54) FILTER BAG MOUNTING ASSEMBLY

(75) Inventors: Gregg A. McAllise, Avon Lake, OH (US); David B. Rennecker, Canton, OH (US); Daniel L. Steele, Concord, OH (US); Michael R. Seamon, Cleveland, OH (US); Laura L. Winkelmann, Fairview Park, OH (US)

(73) Assignee: The Scott Fetzer Company, Westlake, OH (US)

( * ) Notice: Subject to any disclaimer, the term of this patent is extended or adjusted under 35 U.S.C. 154(b) by 325 days.

(21) Appl. No.: 12/100,109

(22) Filed: Apr. 9, 2008

(65) Prior Publication Data

US 2009/0255224 A1 Oct. 15, 2009

(51) Int. Cl.
*B01D 46/00* (2006.01)

(52) U.S. Cl. ..... 55/373; 55/374; 55/375; 15/347

(58) Field of Classification Search ..... 55/369, 55/361, 374, 375, 377, 378, DIG. 2, 367, 55/362, 373; 15/347, 350, 351, 352, 353
See application file for complete search history.

(56) References Cited

U.S. PATENT DOCUMENTS

| | | | | |
|---|---|---|---|---|
| 2,975,862 | A | | 3/1961 | Goldberg |
| 3,209,523 | A | | 10/1965 | Smithson |
| 4,364,757 | A | | 12/1982 | Leonatti |
| 4,589,986 | A | | 5/1986 | Greskovics et al. |
| 4,601,735 | A | | 7/1986 | Morton |
| 4,678,486 | A | | 7/1987 | Jacob et al. |
| 4,738,697 | A | | 4/1988 | Westergren |
| 4,851,019 | A | | 7/1989 | Ahlf et al. |
| 4,877,432 | A | | 10/1989 | Lackner |
| 5,064,455 | A | | 11/1991 | Lackner |
| 5,089,038 | A | | 2/1992 | Kopco |
| 5,092,915 | A | | 3/1992 | Lackner |
| 5,158,635 | A | * | 10/1992 | Schmierer et al. ..... 156/217 |
| 5,464,460 | A | | 11/1995 | Bosses |

(Continued)

FOREIGN PATENT DOCUMENTS

DE 3403135 8/1985

(Continued)

OTHER PUBLICATIONS

Office action issued Dec. 17, 2009 by the Canadian Intellectual Property Office for Canadian Patent Application No. 2638641.

(Continued)

*Primary Examiner*—Duane Smith
*Assistant Examiner*—Minh-Chau Pham
(74) *Attorney, Agent, or Firm*—Jones Day

(57) ABSTRACT

A filter bag includes a bag structure of filter material. A panel is adhered to the bag structure and has a fill opening. A securing tab is attached by a hinge to the panel. The panel is configured to have a mounted position in which a fill tube projects through the fill opening into the bag structure to exhaust air into the bag structure. The panel can be secured in the mounted position by the attachment tab being manually pivoted about the hinge into attachment with an attachment structure coupled to the fill tube.

21 Claims, 10 Drawing Sheets

U.S. PATENT DOCUMENTS

| | | | | |
|---|---|---|---|---|
| 5,472,460 | A | 12/1995 | Schmierer | |
| 5,544,385 | A | 8/1996 | Jailor et al. | |
| 5,755,009 | A | 5/1998 | Stephens | |
| 5,792,224 | A | 8/1998 | Fu et al. | |
| 5,907,886 | A | 6/1999 | Buscher | |
| 6,073,302 | A | 6/2000 | Buscher | |
| 6,314,610 | B1 | 11/2001 | Miller | |
| 6,379,408 | B1 | 4/2002 | Embree et al. | |
| 6,381,804 | B1 | 5/2002 | Paterson et al. | |
| 6,716,262 | B2 * | 4/2004 | Zimet et al. | 55/369 |
| 6,886,215 | B2 | 5/2005 | Dodson et al. | |
| RE38,842 | E | 10/2005 | Fish et al. | |
| 7,076,832 | B2 | 7/2006 | Albert et al. | |
| 7,251,854 | B2 | 8/2007 | Gerth et al. | |
| 7,258,709 | B2 | 8/2007 | Ponjican et al. | |
| 7,325,272 | B2 * | 2/2008 | Bosses | 15/327.2 |
| 7,468,083 | B2 * | 12/2008 | Davis et al. | 55/362 |
| D600,868 | S | 9/2009 | Rennecker et al. | |
| 2009/0217481 | A1 | 9/2009 | Matter et al. | |

FOREIGN PATENT DOCUMENTS

| | | |
|---|---|---|
| EP | 0157918 | 12/1984 |
| WO | WO 2007/087591 | 8/2007 |

OTHER PUBLICATIONS

Examiner's Report, issued Nov. 30, 2009, by IP Australia for Australian Patent Application No. 2008207570.

* cited by examiner

FILTER BAG MOUNTING ASSEMBLY

TECHNICAL FIELD

The application relates to means for attaching a filter bag to a vacuum cleaner.

BACKGROUND

A filter bag collects dirt that is removed from household surfaces by a vacuum cleaner. The filter bag has a mounting collar with an opening. The bag can be removably mounted on a fill tube of the vacuum cleaner, with the fill tube extending through the collar opening into the bag to extend dirt-laden air into the bag.

SUMMARY

A filter bag includes a bag structure of filter material. A panel is adhered to the bag structure and has a fill opening. A securing tab is attached by a hinge to the panel. The panel is configured to have a mounted position in which a fill tube projects through the fill opening into the bag structure to exhaust air into the bag structure. The panel can be secured in the mounted position by the attachment tab being manually pivoted about the hinge into attachment with a securing structure coupled to the fill tube.

Preferably, a second tab is attached to the panel by a second hinge, and is configured to be pivoted about the second hinge to bring the second hinge into attachment with a securing structure coupled to the fill tube. The two hinges can be at laterally opposite sides of a top edge of the panel from each other. The panel can have laterally opposite side edges that are inclined toward each other in a direction away from the top edge, such that the top edge and the side edges define a trapezoid. The trapezoid is further defined by a laterally-extending bottom edge of the panel, with the bottom edge being narrower than the width of the fill opening.

DETAILED DESCRIPTION

Overview

The drawings and following description provide examples of the elements recited in the claims. These examples enable a person of ordinary skill in the art to make and use the invention, including best mode, without implying limitations not recited in the claims.

Figure 1:
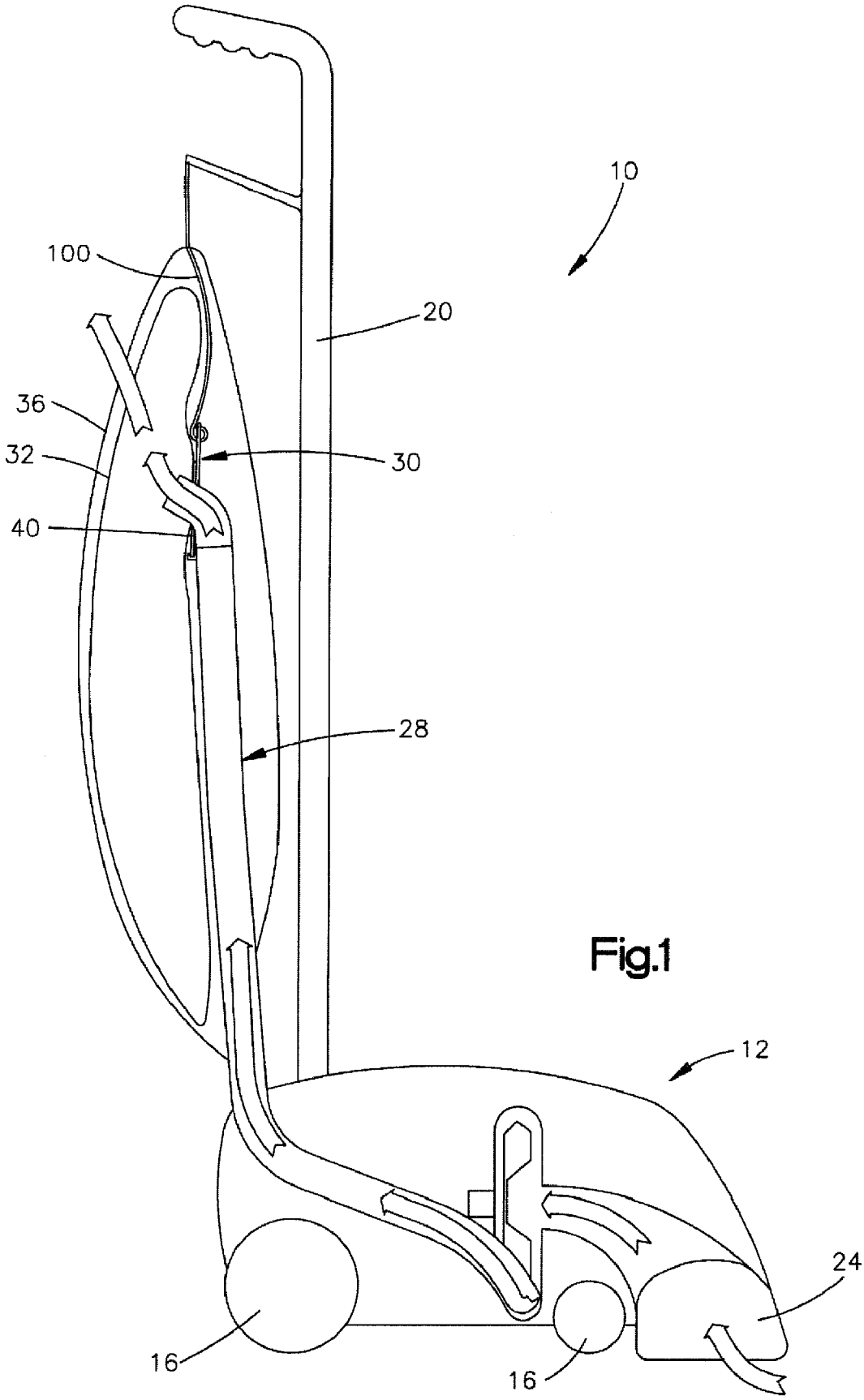
FIG. 1 is a schematic view of a vacuum cleaner that has a filter bag mounted on a fill tube.

FIG. 1 shows a vacuum cleaner 10. It has a base 12 with wheels 16, a handle 20, an inlet nozzle 24 and an outlet tube 28. A mounting bracket 30 is affixed to the top of the outlet tube 28. A disposable inner filter bag 32 is encased in a cloth permanent outer filter bag 36 suspended from the handle 20. The inner bag 32 has a mounting collar 40 by which it is removably secured to the bracket 30. In operation, the base 12 draws dirt-laden air in through the nozzle 24 and exhausts it through the outlet tube 28, the bracket 30 and the collar 40 into the inner bag 32. The air escapes through the inner and outer bags 32 and 36 to the atmosphere, and the dirt is retained in the inner bag 32.

Mounting Bracket

Figure 2:
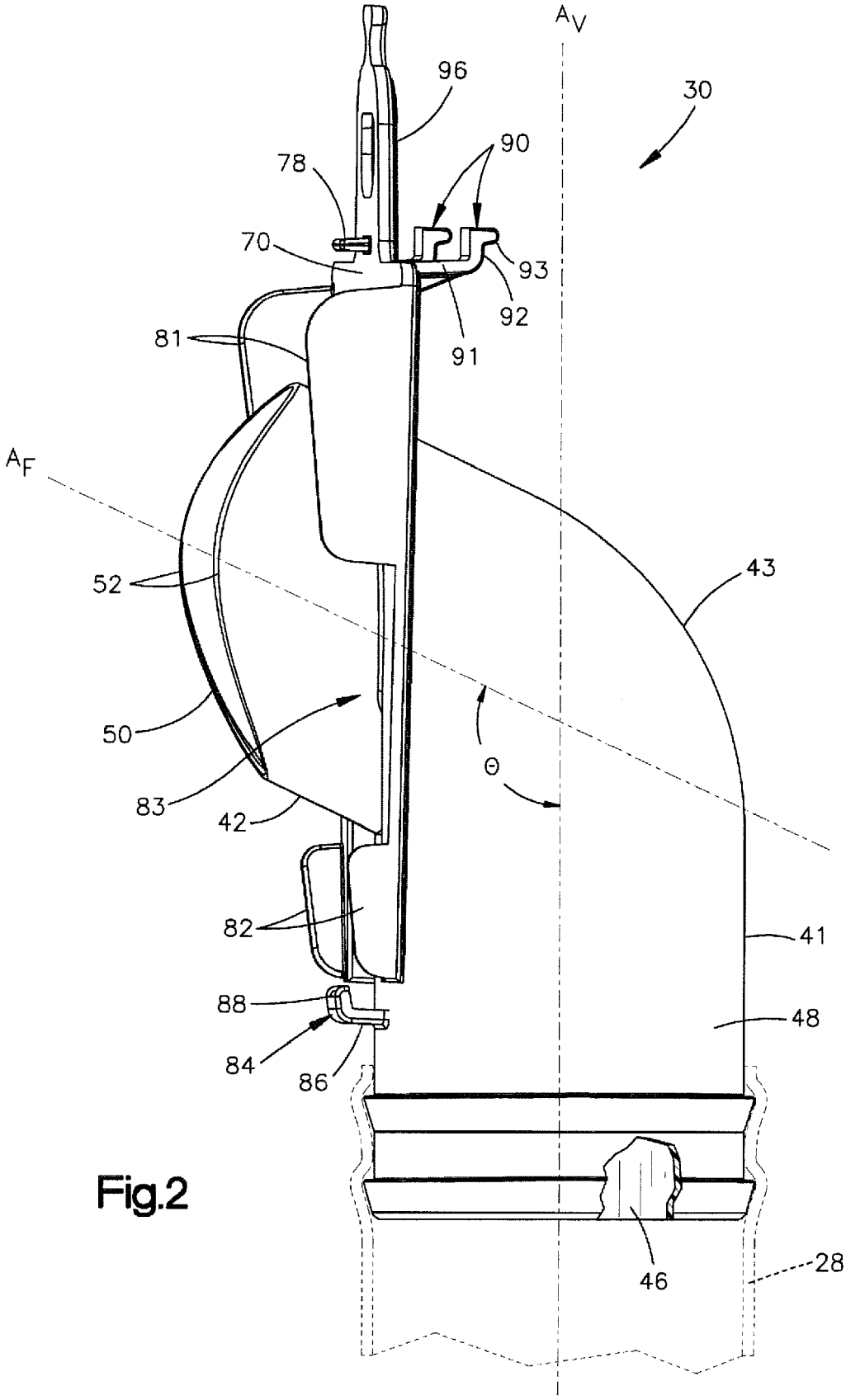
FIGS. 2-3 are different perspective views of a mounting bracket at the top of the fill tube.

FIG. 2 shows the mounting bracket 30. It can be described with respect to a vertical axis Av. Relative to vertical, a "lateral" direction extends horizontally. The directional terms recited herein, such as vertical and horizontal, top and bottom, and side, are with respective to orientations of the parts in the figures, and thus do not exclude use of the parts in other orientations.

The mounting bracket 30 includes a tube structure comprising a proximal vertical tube section 41, a distal tube section 42, and an elbow section in-between 43. The distal tube section 42 is a "fill tube" in that, during use, it projects forward through bag collar 40 into the inner bag 32 to fill the inner bag 32 with dirt. The proximal and distal tube sections 41, 42 each have a cylindrical inner surface 46 and a cylindrical outer surface 48. To facilitate describing the bracket 30, the proximal tube section 41 is shown centered on the vertical axis $A_V$. The fill tube section 42 is centered on a fill tube axes $A_F$. The fill tube 42 axis is at an angle θ (relative to a vertically upward direction) of 90-135° (135° in this example), so that it redirects the air flowing through it by the angle θ. Increasing the angle θ above 90° can reduce air resistance. In the side profile of the bracket 30, shown in FIG. 2, the front edge 50 of the fill tube 42 is bowed forward at its vertical center 52. Accordingly, the edge 50 recedes rearward, both upward and downward from the vertical center 52.

Figure 3:
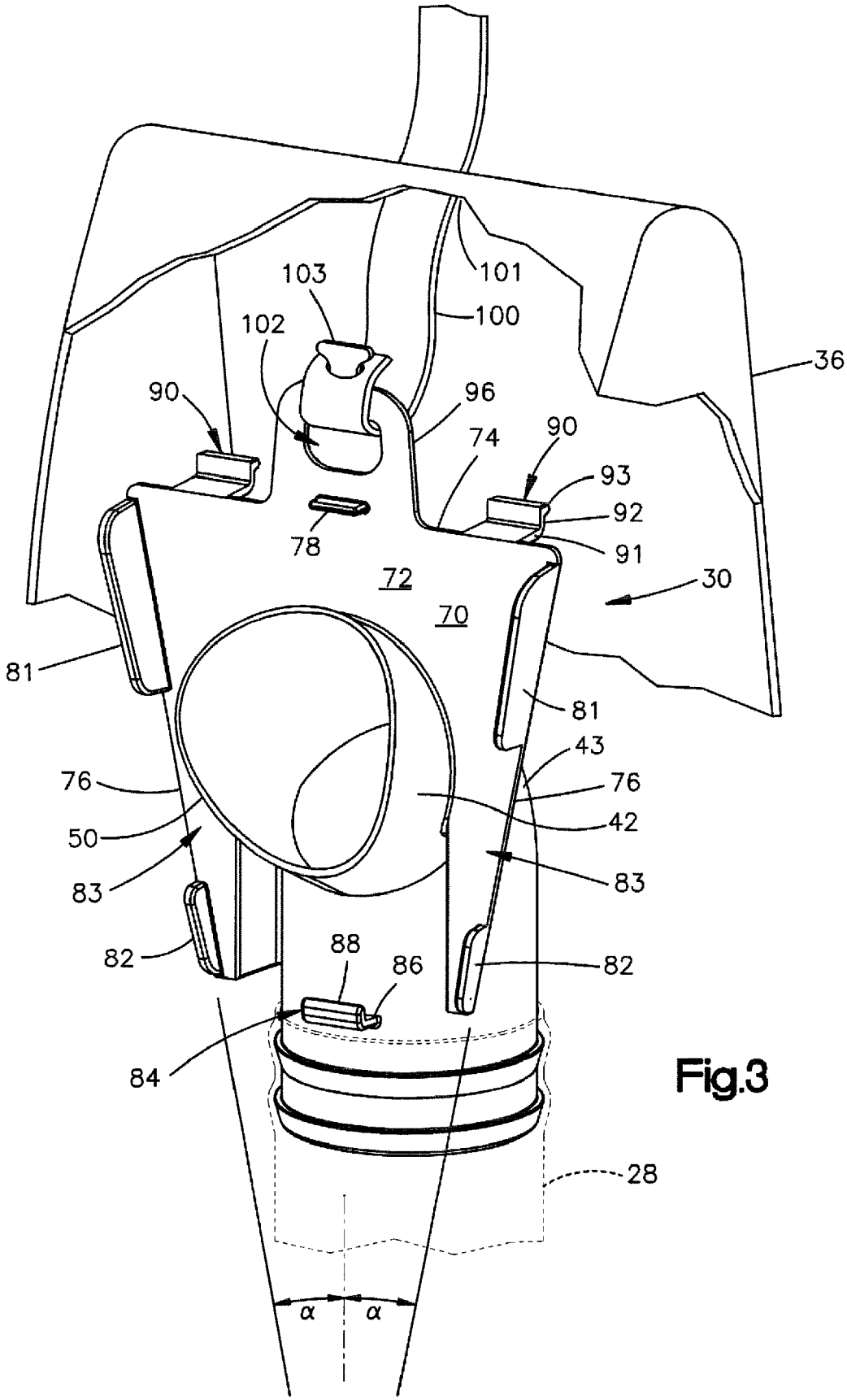

As shown in FIG. 3, the mounting bracket 30 has a vertical abutment plate 70 located between the tube's elbow 43 and its distal edge 50. The plate 70 has a front face 72, through which the fill tube 42 projects. The plate 70 has a peripheral edge defining an isosceles trapezoid in that the plate 70 has a laterally-extending top edge 74, and two opposite side edges 76 that are inclined downward laterally inward (i.e., toward each other) at an angle α relative to vertical. Centered above the fill tube 42, a horizontal top flange 78 projects forward from the plate 70.

From each side edge of the plate 70, an upper side rail 81 and a lower side rail 82 project forward, with a gap 83 in-between. A bottom hook 84 has two sections: a ledge 86 extending forward from the proximal tube section 41 and an upward projection 88.

Two top securing structures 90, in this case hooks, are located at opposite ends of the top edge 74 of the abutment plate 70. Each top hook 90 includes a proximal flange 91 projecting rearward from the top edge 74, an upward-projecting middle flange 92, and a rearward-projecting distal flange 93. Each top hook 90 is thus coupled to the fill tube 42 by the abutment plate 70.

The top edge 74 is interrupted by a suspension tab 96 that projects upward from the abutment plate 70. The tab 96 is coplanar with and an extension of the plate 70, and is laterally centered on the plate 70. The tab 96 removably connects the plate 70 to a strap 100 suspended from an attachment point 101 at the top of the interior of the outer bag 36. The strap 100 extends through a hole 102 in the suspension tab 96 and over a T-shaped hook 103 at the top of the tab 96.

Mounting Collar

Figure 4:
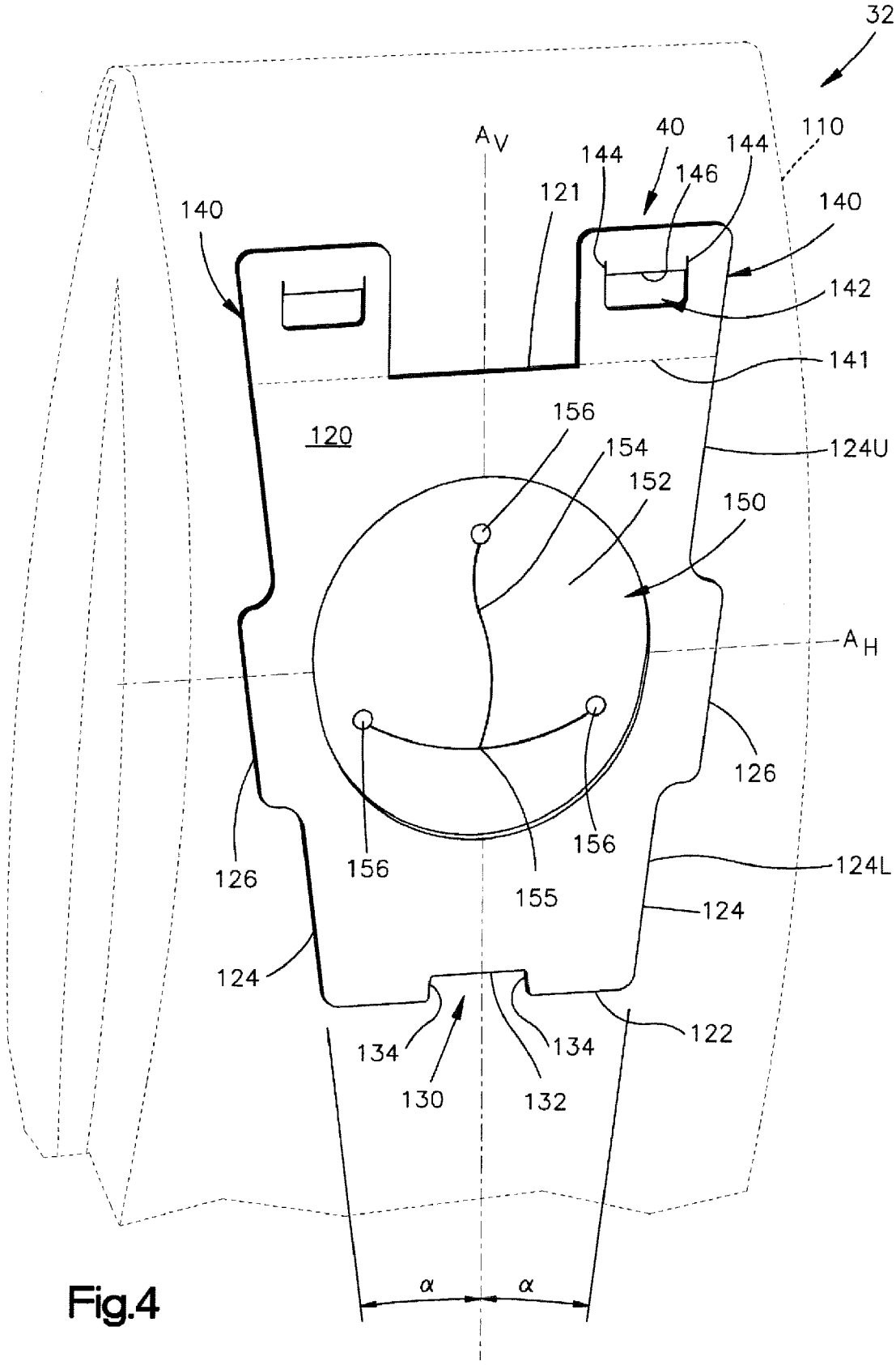
FIG. 4 is a perspective view of a mounting collar of the filter bag.

The inner filter bag 32 is shown in FIG. 4. It includes the mounting collar 40 adhered to a bag structure 110 of paper-like or cloth-like porous filter material.

The mounting collar 40 includes a stiff cardboard panel 120. In FIG. 4, the panel 120 is shown centered on a vertical axis $A_V$ and a horizontal axis $A_H$. The horizontal axis $A_H$ extends laterally relative to the vertical axis $A_V$. The panel 120 has a peripheral edge defining an isosceles trapezoid. The edge includes mutually-parallel laterally-extending top and bottom edges 121 and 122 and two opposite side edges 124. The side edges 124 are inclined downward and laterally inward (i.e., toward each other) at the angle $\alpha$. Each side edge 124 is interrupted by a side tab 126. The side tab 126 divides the side edge 124 into two collinear side edges: an upper side edge 124U and a lower edge 124L. Each side tab 126 is coplanar with and an extension of the panel 120. The side tab 126 projects laterally outward from the trapezoidal outline and from between the upper and lower side edges 124U, 124L. The bottom edge 122 is interrupted by an upwardly-extending notch 130. The notch 130 is bounded by a top edge 132 and two opposite side edges 134. The top edge 132 is a seating edge configured to be seated on the bracket's ledge 86.

Two securing tabs 140 extend upward from laterally-opposite ends of the panel's top edge 121. Each securing tab 140 is coplanar with, and an extension of, the panel 120. The tabs 140 and the panel 120 can be stamped out from a single piece of cardboard as a one-piece unit. Each tab 140 is attached to the panel 120 by a hinge 141. In this example, the hinge is a living hinge, comprising a weakened portion of the cardboard itself, such as by a slit that extends partially through the cardboard's thickness, or a crease or fold line in the cardboard material. In FIG. 4, the slit 141 is indicated by a dashed line, because it is cut into the panel's rear surface which is not visible in FIG. 4. Each tab 140 has a generally-rectangular securing hole 142. Two parallel slits 144 extend upward from laterally-opposite ends of the hole 142 to define an elastic tongue 146. The tongue 146 projects downward to the hole 142, with the tongue's distal edge bordering the hole 142.

In an alternative embodiment not shown, a substantial portion of, including possibly all of, each attachment tab can be of flexible, elastically flexibly and/or elastically stretchable material.

The panel 120 has an oval almost-circular fill opening 150. A diaphragm 152 extends across the fill opening 150 and has an anchor-shaped slit pattern 154. The slit pattern 154 has three slits projecting in three different directions from a common node 155. The diaphragm 152 has a round hole 156 at the distal end of each slit to reduce concentration of tension at the distal end when the diaphragm 152 is stretched about the fill tube 42 (FIG. 3).

Procedure for Mounting the Collar on the Bracket

Figure 5:
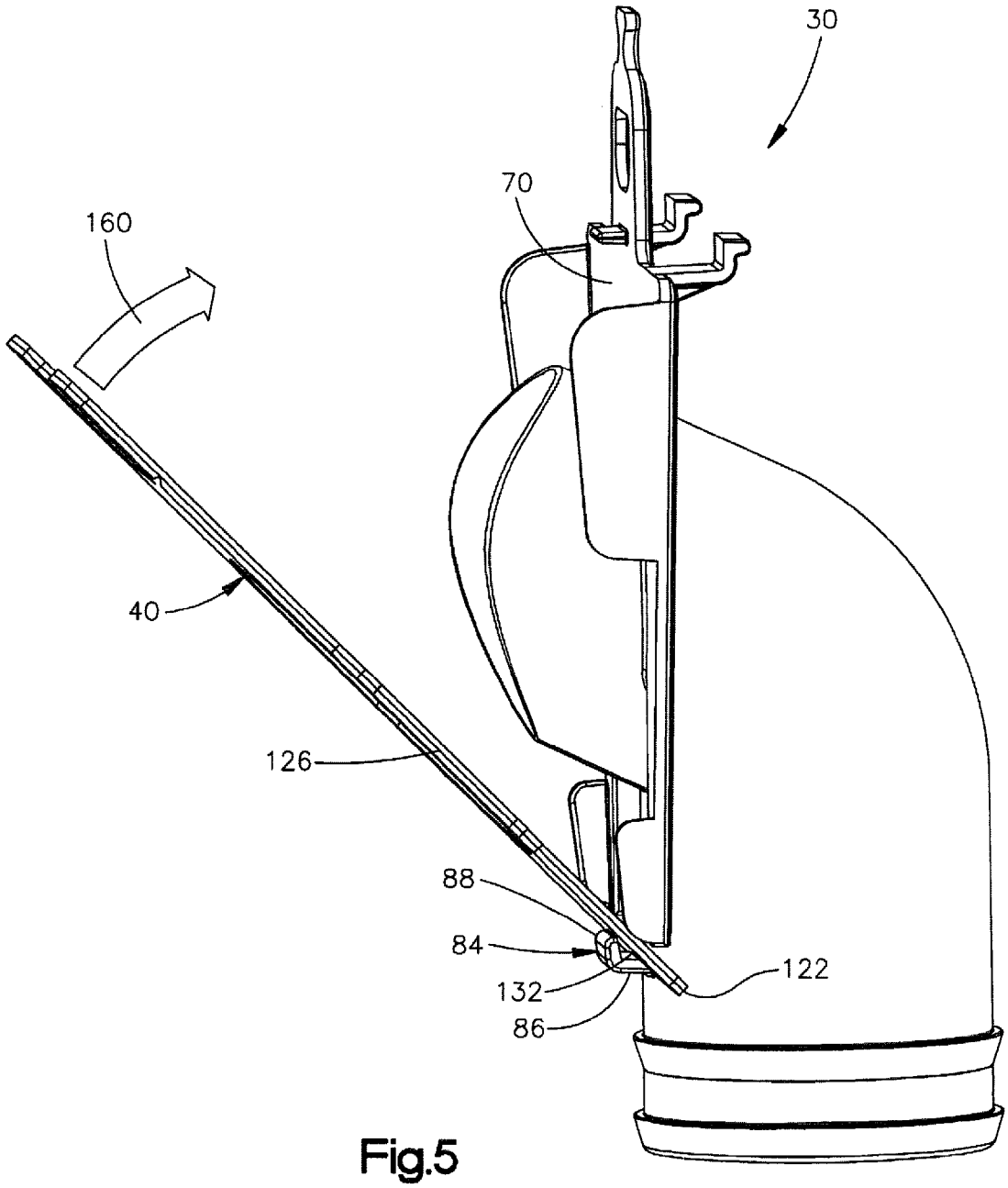
FIGS. 5-7 are three perspective views showing a sequence of steps for mounting the collar on the bracket.
Figure 6:
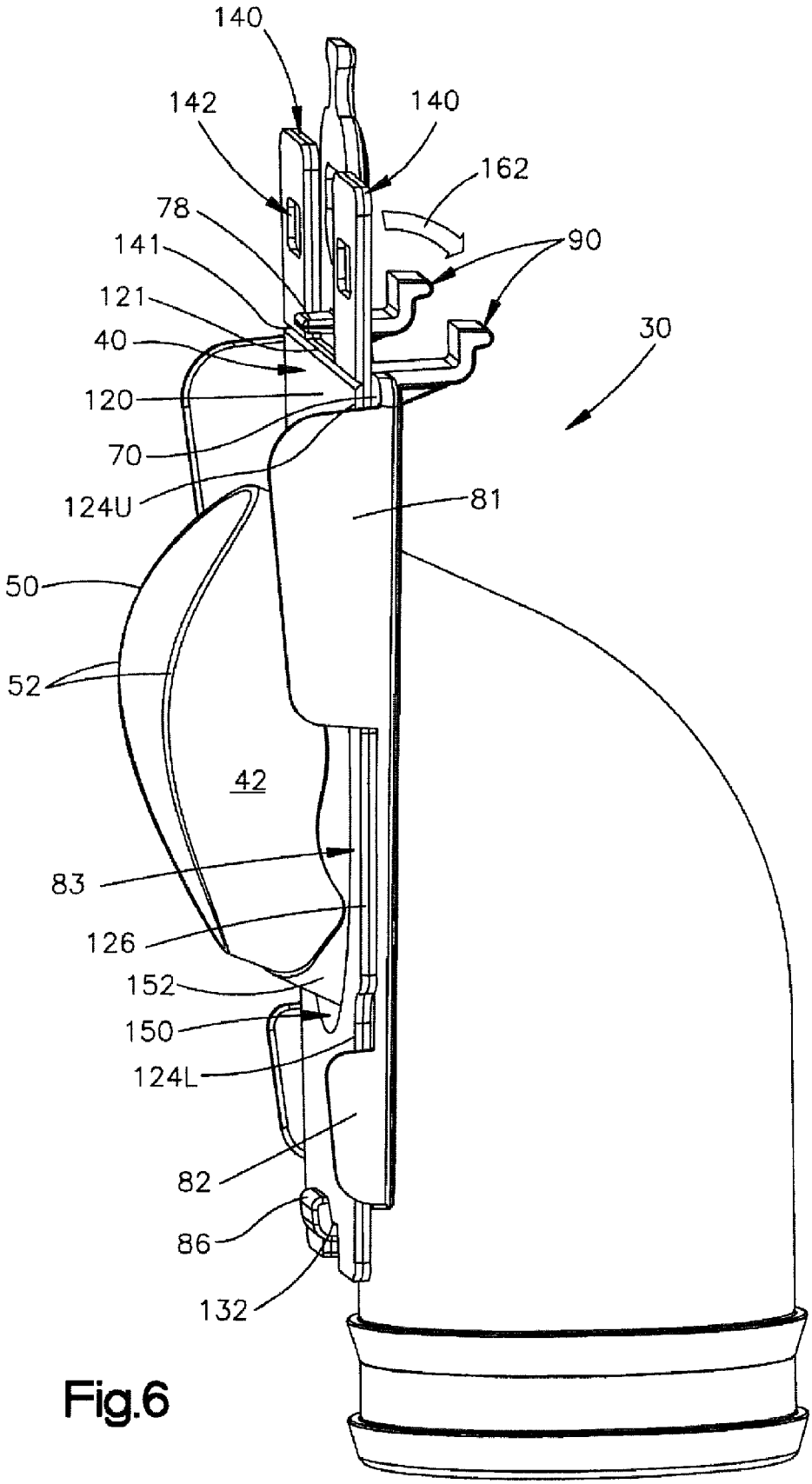
Figure 7:
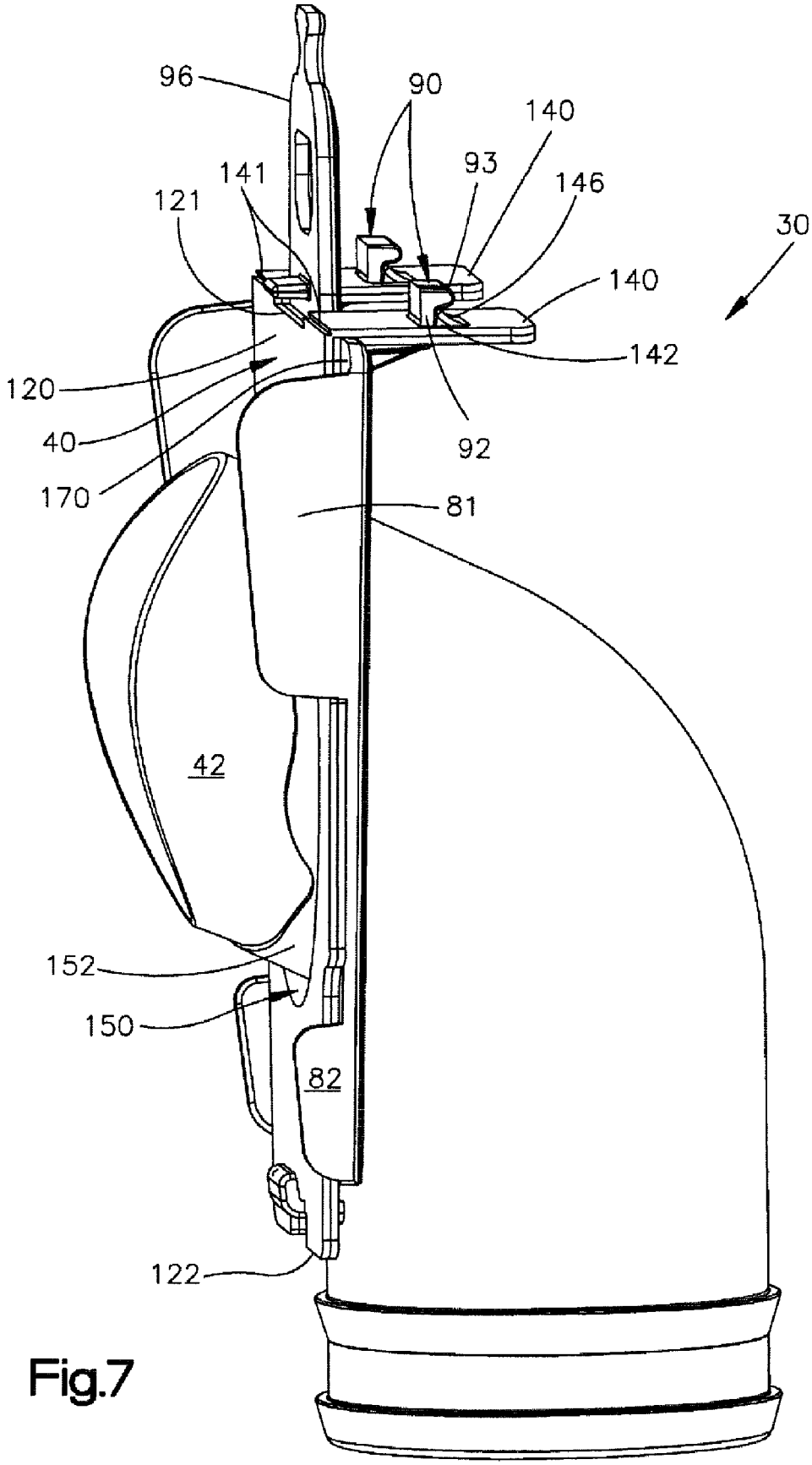

A procedure for mounting the collar 40 on the fill tube bracket 30 can have a sequence of steps illustrated in FIGS. 5-7. Parts that are referred to in the following explanation but obscured in FIGS. 5-7 are visible in FIGS. 3-4.

In a seating step shown in FIG. 5, the top edge 132 (or "seating edge") of the collar notch 130 is seated on the bracket's ledge 86. In this position, lateral movement of the panel 120 is limited by abutment of the notch's two side edges 134 against the bracket's ledge 86, and forward movement of the collar's bottom end 122 is limited by the upward projection 88 at the end of the ledge 86.

Next, in a pivoting step, the collar 40 is pivoted (arrow 160 in FIG. 5) about the top edge 132 of the notch 130 toward the abutment plate 70. The collar 40 reaches a mounted position shown in FIG. 6 in which it abuts the bracket's abutment plate 70. The panel's two side tabs 126 are received in the bracket's two side gaps 83. Upward movement of the panel 40 is limited by abutment of the side tabs 126 against the upper side rails 81 and/or by abutment of the panel's top edge 121 against the bracket's top flange 78. The collar 40 is laterally captured by abutment of the collar's upper and/or lower side edges 124U, 124L against the bracket's upper and/or lower side rails 81, 82.

During the pivoting step, the user's fingers grasp the collar 40 by the laterally-outer edges of its side tabs 126. The side rails 81, 82 would obstruct the fingers from engaging the collar's side edges 124U, 124L when the reaching the mounted position of FIG. 6.

During the pivoting step, the first parts of the fill tube 42 to engage the diaphragm 152 are the vertical centers 52 of the front edge 50. Accordingly, the force that opens the slit pattern 154 (FIG. 4) of the diaphragm 152 to receive the fill tube 42 is initially concentrated at two laterally-opposite locations 52. This lessens the force needed to push the diaphragm 152 over the tube 42.

In a securing step, each of the collar's two securing tabs 140 is pivoted (arrow 162) about its hinge 141 downward over the respective top hook 90. The tab 140 is pulled rearward to bring the tab's hole 142 over the end of the hook 90. This brings each tab 140 into an attached condition shown in FIG. 7. In this condition, the tab 140 projects rearwardly and perpendicularly from the panel 120. Elasticity of the panel 120, tensile elasticity of the attachment tab 140, compressive or flexural elasticity of the tongue 146, and/or elasticity of the respective top hook 90 help urge the tongue 146 into abutment with the hook's vertical flange 92. The tab 140 is captured from above by the hook's horizontal distal flange 93.

Removing the collar 40 requires moving each top tab 140 rearward, against bias of the aforementioned elasticity components, to clear the distal flange 93 and slip the tab 140 off the hook 90.

Increasing the lateral distance between the collar's two securing tabs 140, by lengthening the collar's top edge 121, increases the stability of the collar 40 on the bracket 30. It also provides more room for the user's fingers when manipulating the securing tabs 140. To enable lengthening the top edge 74 without increasing the overall surface area of the panel 120, the panel's bottom 122 is made narrower than its top 121, thus yielding the trapezoidal shape. The collar's bottom edge 122 can be narrower than the laterally-extending width (inner diameter) of the panel opening 150, and even narrower than the laterally-extending width (outer diameter) of the fill tube 42.

Alternative Mounting Collar

Figure 8:
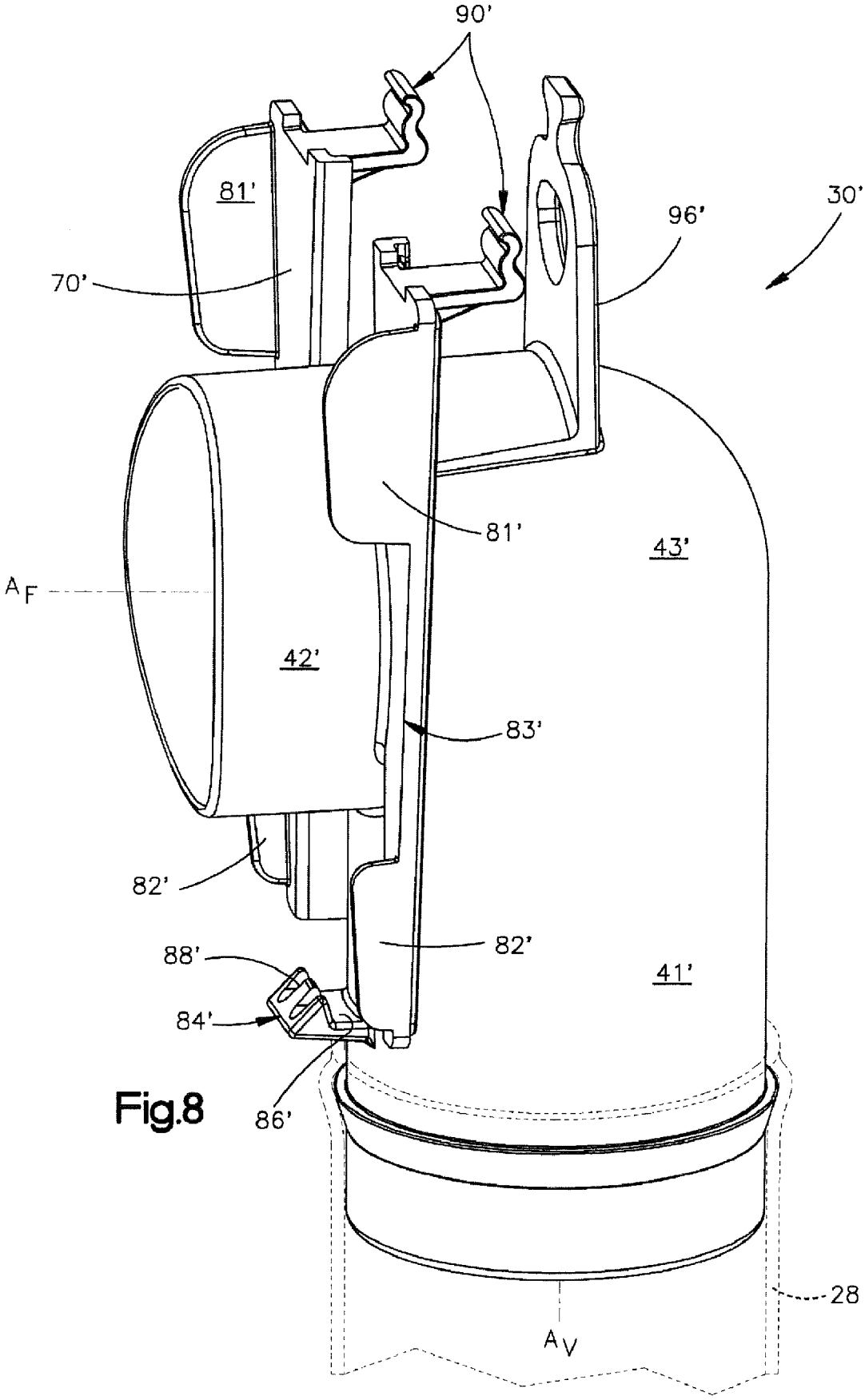
FIG. 8 is a perspective view of an alternative mounting bracket.

FIG. 8 shows an alternative mounting bracket 30'. It can be installed on the fill tube 28 in place of the first mounting bracket 30 of FIGS. 2-3. It can also be used to mount the filter bag 32 (FIG. 4) in the same manner as the first mounting bracket 30. This second mounting bracket 30' has most of the features of the first mounting bracket 30. They are respectively labeled with primed reference numbers matching unprimed reference numbers of the corresponding features of first mounting bracket 30.

The second bracket 30' differs from the first bracket 30 in the following ways:

The central axis $A_F$ of the second bracket's fill tube 42 is perpendicular to the vertical axis $A_V$.

The second bracket's suspension tab 96' does not project from the abutment plate 70'. It instead projects from the elbow section 43' behind the abutment plate 70'. It is inline with the vertical central axis $A_V$ of the proximal tube section 41', to position the suspension point directly above the center of gravity of the outlet tube 28 (FIG. 2). The abutment plate 70' has a gap directly in front of the suspension tab 96', with a width matching the width of the suspension tab 96'.

Figure 9:
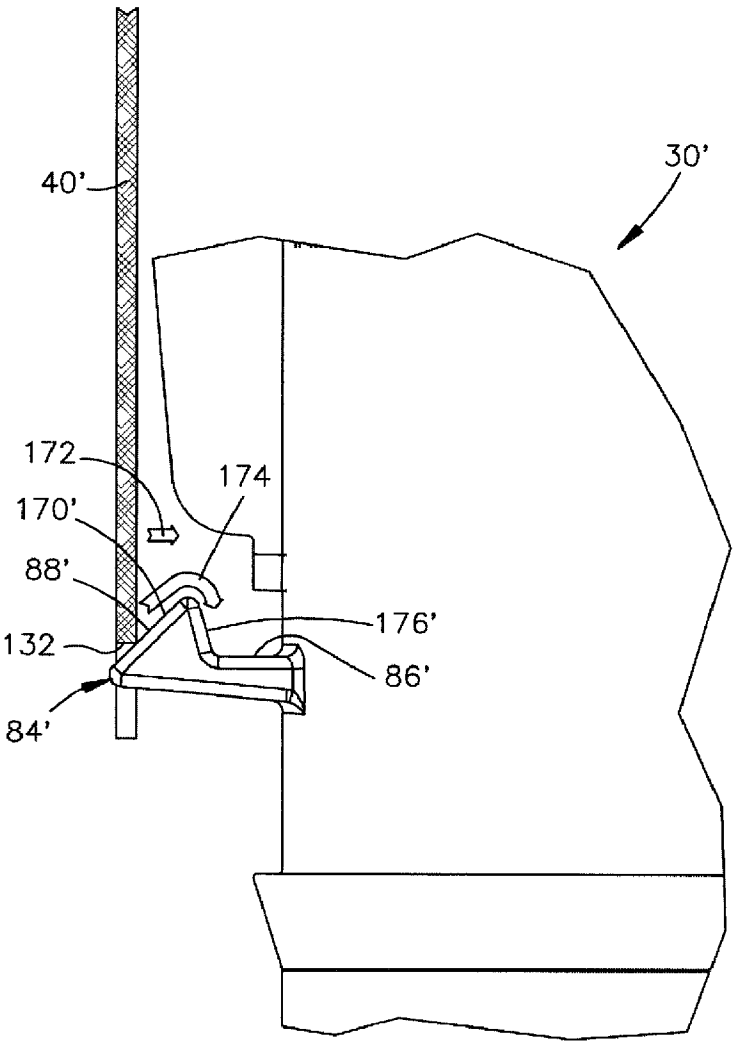

As shown in FIG. 9, the upward projection 88' of the bottom hook 84' is shaped as a wedge. The projection's front surface 170' is inclined rearward, so that manually pushing the collar 40 directly rearward (arrow 172) against the front surface 170' will urge the collar 40 to slide (arrow 174) up and over the wedge 84'.

Figure 10:
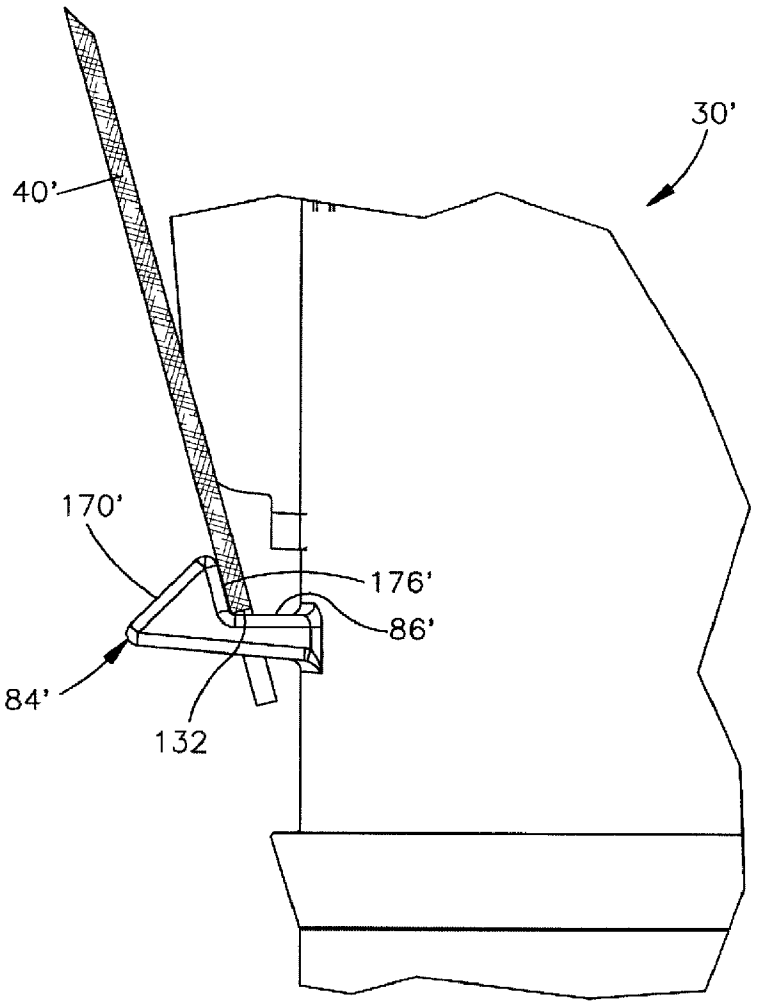
FIGS. 9-12 are different sectional views illustrating steps for mounting the collar on the alternative bracket.

As shown in FIG. 10, the projection's rear surface 176' is inclined forward, to better match the angle of incline of the collar 40 during the seating step, while preventing the collar 40 from slipping forwardly off the ledge 86'.

Figure 11:
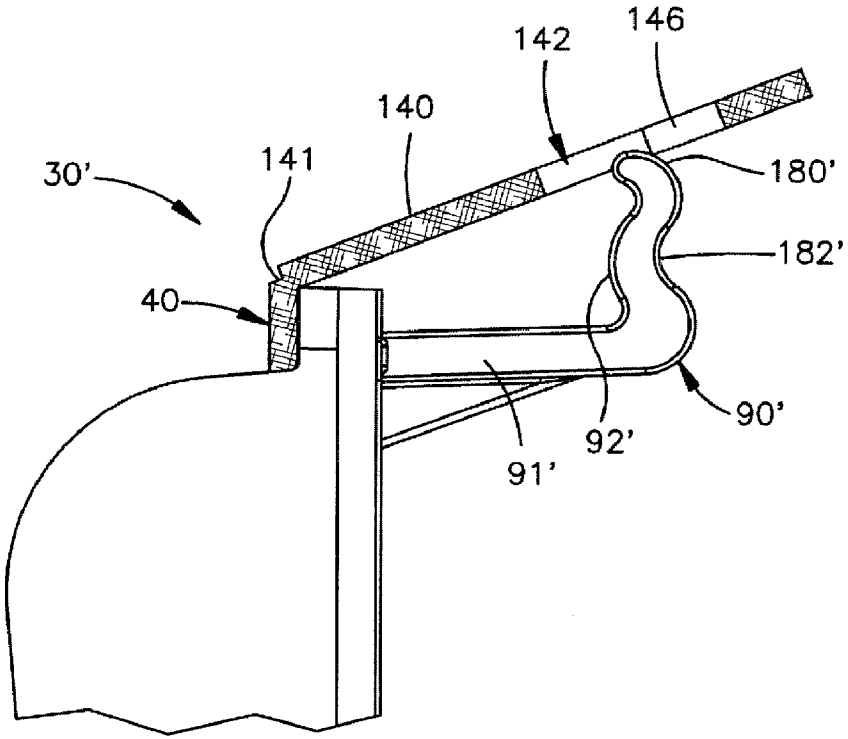

As shown in FIG. 11, the vertical flange 92' of each top hook 90' is bent forward at its top to provide an inclined surface 180' over which the collar's tongue 146 slides. The incline of this surface 180' urges the tongue 146 rearward as the tab 140 is pivoted downward.

Figure 12:
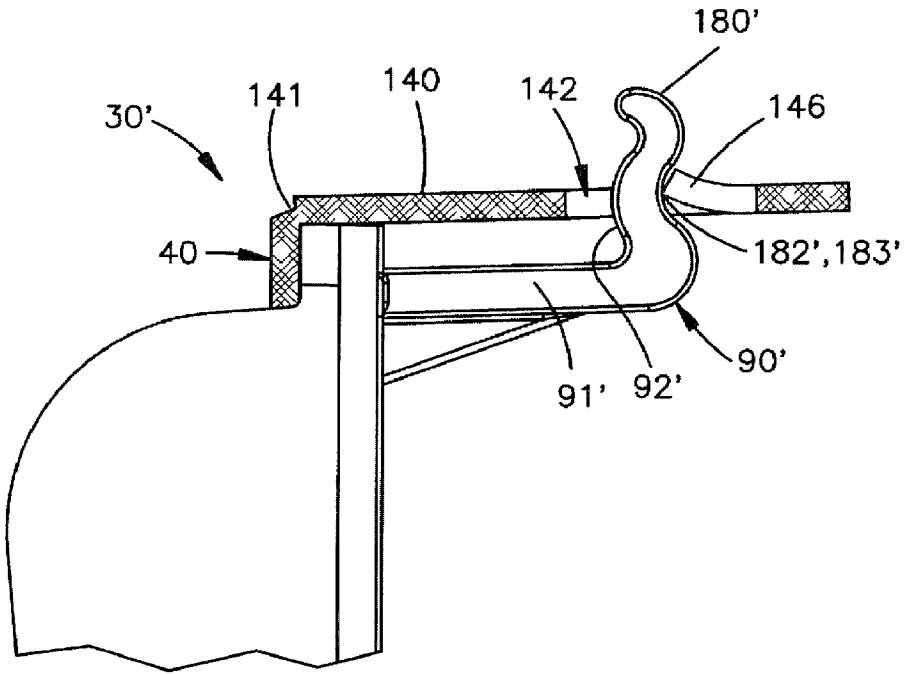

As shown in FIG. 12, the top hook's vertical flange 92' has a dip 182' at its center, into which the tongue 146 of the securing tab 140 is seated. The dip 182' thus provides an attachment location where the collar 40 is attached by the bracket 30' to the fill tube 42'. The tongue's flexural elasticity keeps the tongue's distal edge 183' (or "abutment edge") pressed against the hook 90' at the attachment location 182'.

The scope of the invention is defined by the claims, and may include other examples that occur to those skilled in the art. Such other examples are intended to be within the scope of the claims if they have elements that do not differ from the literal language of the claims, or if they include equivalent structural elements with insubstantial differences from the literal language of the claims.

The invention claimed is:

1. A filter bag comprising:

a bag structure of filter material;

a panel adhered to the bag structure and having a fill opening; and an elastically stretchable securing tab attached by a hinge to the panel;

the panel being configured to have a mounted position in which a fill tube projects through the fill opening into the bag structure to exhaust air into the bag structure, and to be secured to the fill tube in the mounted position by manually pivoting the securing tab about the hinge to bring the tab into attachment with a securing structure coupled to the fill tube.

2. The bag of claim 1 further comprising a second securing tab attached to the panel by a second hinge, and configured to be manually pivoted about the second hinge to bring the second tab into attachment with a securing structure coupled to the fill tube.

3. The bag of claim 2 wherein the two hinges are at laterally opposite sides of a top edge of the panel from each other.

4. The bag of claim 3 wherein the panel has laterally opposite side edges that are inclined downward toward each other, such that the top edge and the side edges define a trapezoid.

5. The bag of claim 4 wherein the trapezoid is further defined by a laterally-extending bottom edge of the panel, the bottom edge being narrower than the width of the fill opening.

6. The bag of claim 1 wherein said pivoting pivots the tab to be perpendicular to the panel.

7. The bag of claim 1 wherein the securing structure is a hook, and the tab has a hole configured to receive the hook.

8. The bag of claim 1 wherein the panel is further configured to be released from the fill tube by manually pivoting the securing tab about the hinge to remove the tab from the securing structure.

9. A filter bag comprising:

a bag structure of filter material; and a panel adhered to the bag structure and extending along a lateral axis and having a fill opening configured to receive a fill tube, the panel having an external periphery that follows a trapezoid defined by a laterally-extending top edge and a narrower laterally-extending bottom edge and two laterally-opposite sides that are inclined downwardly laterally-inward, the width of the bottom edge being narrower than the width of the fill opening.

10. The bag of claim 9 further comprising two securing tabs extending upward from two laterally-opposite ends of the top edge.

11. A filter bag comprising:

a bag structure of filter material;

a panel adhered to the bag structure and having a fill opening; and a securing tab attached to the panel, the tab having:

a securing hole;

two slits cut into the tab and projecting from the hole; and a tongue formed by and between the two slits and having a distal edge bordering the hole;

configured for a fill tube to project through the fill opening into the bag structure while a hook coupled to the fill tube projects through the securing hole and presses against the tongue's distal edge to secure the panel to the fill tube.

12. The bag of claim 11 wherein the tab is hingedly attached to the panel.

13. An apparatus comprising:

a bag structure of filter material;

a panel adhered to the bag structure and located on a lateral axis, the panel having a fill opening and two laterally-opposite sides, each side having upper and lower side edges and a side tab projecting laterally outward from between the upper and lower side edges;

a fill tube projecting forward along a fill tube axis; and a bracket attached to the fill tube and having laterally-opposite sides, each side having upper and lower side rails that project forward parallel with the fill tube axis and a gap between the upper and lower side rails;

the panel being configured for a user's fingers to grasp the side tabs to move the panel rearwardly all the way into a mounted position in which the fill tube projects forward through the fill opening into the bag structure and the panel is laterally captured between the two upper rails and between the two lower rails and the two side tabs project through the two gaps.

14. The apparatus of claim 13 wherein the upper and lower side edges of each side of the panel are collinear.

15. The apparatus of claim 13 wherein, in the panel's mounted position, the panel is laterally captured by abutment of the panel's upper side edges against the bracket's upper rails and by abutment of the panel's lower side edges against the bracket's lower rails.

16. The apparatus of claim 13 wherein the upper and lower side edges of each side are inclined toward each other.

17. An apparatus comprising:

a mounting bracket including an abutment plate, a fill tube and a hook;

a bag structure of filter material;

a panel adhered to the filter bag and located on a lateral axis and having a fill opening, the panel having a periphery that follows a trapezoid defined by a wider laterally-extending top edge, a narrower laterally-extending bottom edge and two laterally-opposite inclined sides, the panel having a seating edge adjacent the bottom edge;

the panel being configured to be mounted on the bracket by seating the panel's seating edge on the hook and then pivoting the panel about the seating edge into abutment with the abutment plate, with the fill tube projecting through the fill opening into the bag structure.

18. The apparatus of claim 17 wherein the panel has a notch extending upward from the bottom edge, and said seating edge is the top edge of the notch.

19. The apparatus of claim 17 wherein the panel has two securing structures at the two laterally-opposite ends of the panel's top edge for securing the panel to the fill tube.

20. The apparatus of claim 17 wherein the panel's bottom edge is narrower than the width of the panel's fill opening.

21. A fill tube apparatus comprising:

an abutment plate with a front face and a top end;

a fill tube projecting forward through the front face;

a forward-projecting ledge coupled to and located below the fill tube; and an upward projection adjoining the ledge, the projection having a front surface that is inclined upwardly rearward so as to urge a mounting collar of a filter bag, being pressed rearwardly against the projection's front surface, to slide upward and over the projection;

the apparatus being configured for a filter bag mounting collar to be seated on the ledge and abut the front face and prevented by the upward projection from slipping forwardly off the ledge, as the fill tube projects through the mounting collar into the bag;

and wherein the projection has a rear surface inclined upwardly forward.

* * * * *